United States Patent [19]

Chen et al.

[11] Patent Number: 4,898,323

[45] **Date of Patent: * Feb. 6, 1990**

[54] MAILER FOR LASER PRINTER

[75] Inventors: Tien-Tsung Chen, Claremont; C. Stefan Wegdell, Tustin, both of Calif.; Wayne L. Rutkowski, South Wales, N.Y.; Kim Y. Kao, Alhambra, Calif.

[73] Assignee: Avery International Corporation, Pasadena, Calif.

[ * ] Notice: The portion of the term of this patent subsequent to Nov. 15, 2005 has been disclaimed.

[21] Appl. No.: 270,785

[22] Filed: Nov. 14, 1988

Related U.S. Application Data

[63] Continuation-in-part of Ser. No. 64,074, Jun. 17, 1987, Pat. No. 4,784,317.

[51] Int. Cl.[4] ..... B65D 27/04; B65D 27/14

[52] U.S. Cl. ..... 229/92.3

[58] Field of Search ..... 229/92.3

[56] References Cited

U.S. PATENT DOCUMENTS

| | | | |
|---|---|---|---|
| 122,041 | 12/1871 | Ludlow . | |
| 225,319 | 3/1880 | Barton . | |
| 2,152,135 | 3/1939 | Case et al. . | |
| 3,093,296 | 6/1963 | Wood . | |
| 3,197,121 | 7/1965 | Hayes . | |
| 3,937,492 | 2/1976 | Biron . | |
| 4,031,818 | 6/1977 | Kehoe . | |
| 4,044,942 | 8/1977 | Sherwood . | |
| 4,102,489 | 7/1978 | Lucas | 229/92.3 |
| 4,575,121 | 3/1986 | Conti | 229/92.3 |
| 4,784,317 | 11/1988 | Chen et al. | 229/92.3 |

FOREIGN PATENT DOCUMENTS 691965 8/1964 Canada .

*Primary Examiner*—Stephen P. Garbe

*Attorney, Agent, or Firm*—Poms, Smith, Lande & Rose

[57] ABSTRACT

A one piece mailer includes a standard size sheet which may be employed in laser printers or xerographic machines without special equipment and involves printing on one side only of the mailer. Stable adhesive material which will not run or contaminate the office machines, when it is subject to several hundred degrees heat is used for sealing. This adhesive is preferably water-activated. One embodiment includes a mailing sheet having an upper and lower half, with the upper half carrying the addresses and the message, and the lower half having windows which match the location of the addresses on the upper half of the mailer. The second embodiment involves a mailer having a first full sheet having an upper portion on which messages are printed, and a lower portion on which addresses are printed. On the rear side of the main sheet is a short partial sheet toward the bottom of the main sheet forming an envelope, and with a transverse strip of adhesive immediately above the envelope pocket to seal the envelope. Perforations extend across the main sheet just above the adhesive-coated strip, so that the message section may be separated from the envelope portion, and the message portion folded and placed within the envelope, and the envelope sealed. The third embodiment uses overlying message and envelope sheets, and is similar to the first embodiment in the use of windows in the envelope sheet which expose addresses from the folded message sheet.

19 Claims, 5 Drawing Sheets

Fig. 8.
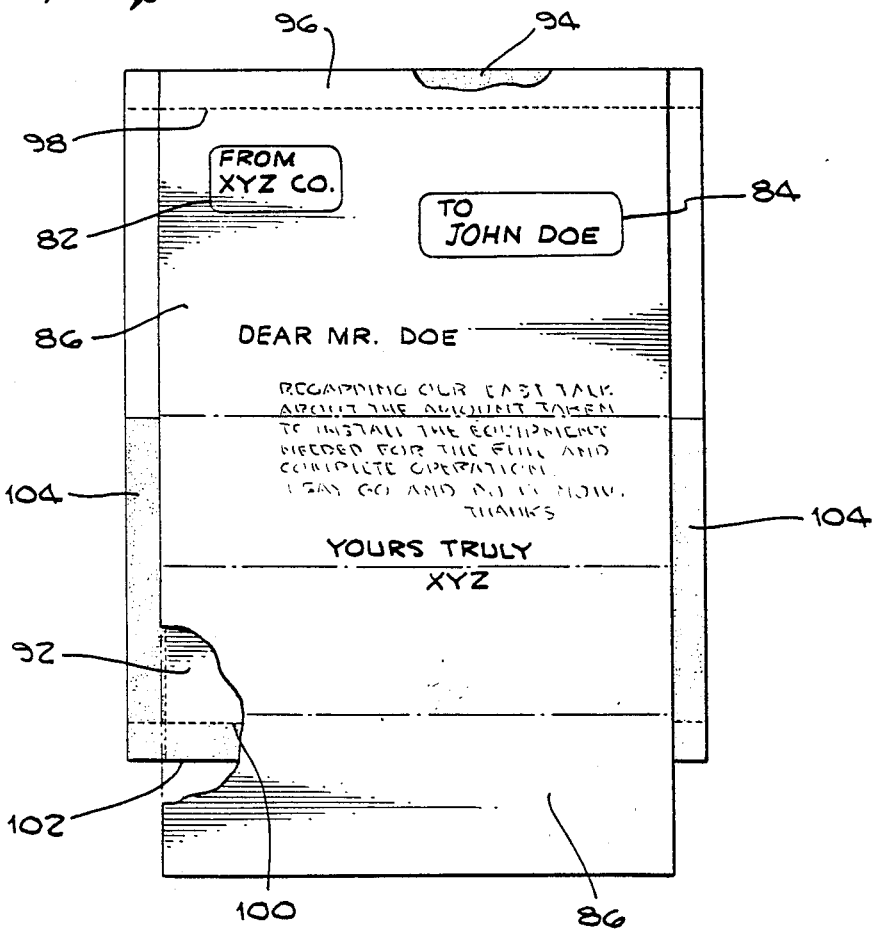
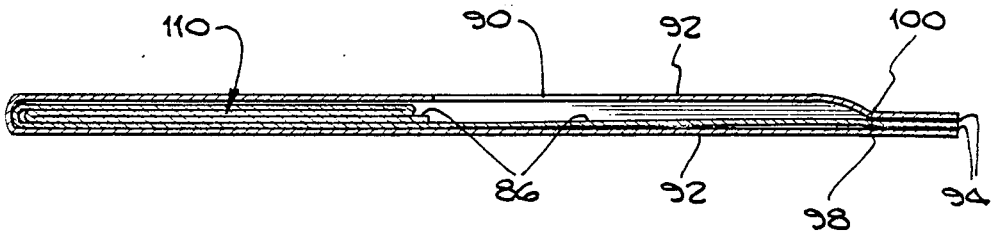
Fig. 11.

MAILER FOR LASER PRINTER

RELATED PATENT APPLICATION

This patent application is a continuation-in-part of U.S. patent application Ser. No. 064,074, filed June 17, 1987, entitled "One Piece Mailer for Laser Printers", issued as U.S. Pat. No. 4,784,317, granted Nov. 15, 1988.

FIELD OF THE INVENTION

This invention relates to unitary mailers for use under adverse heat and moisture conditions.

BACKGROUND OF THE INVENTION

Laser printers are becoming more widely used in business correspondence, in combination with computer terminals. One serious disadvantage of laser printers, however, is that it is not easy to address envelopes. Accordingly, many offices must necessarily have both computer terminals with laser printers, and also have available typewriters for addressing envelopes. To avoid this problem, it would be convenient to use a unitary or one piece mailer in which the address and the message were both printed onto the mailer by the laser printer. However, unitary mailing assemblies normally have natural gum adhesive for closing the mailer and forming it into an envelope. Unfortunately, this type of natural gum adhesive is heat-activated and will contaminate the operative mechanisms of many laser printers or xerographic copiers.

Accordingly, one object of the present invention is to overcome the problems outlined hereinabove.

SUMMARY OF THE INVENTION

In accordance with one embodiment of the invention, a one piece mailer is formed of a single sheet of paper, which may for example, be 8½ inches by 11 inches, or up to 8½ by 14 inches in length, and the addresses and message are typed on the upper one-half of the sheet, which is a continuous, single thickness sheet. The lower half of the sheet is provided with two windows, so that when the sheet is folded in half, the addresses from the upper portion of the sheet are visible through the windows. Incidentally, the upper portion of the sheet includes defined areas or boxes where the name and address of the sender and the addressee are to be located, so that they match the positioning of the windows in the lower half of the sheet. In addition, the lower edge of the lower half of the sheet is provided with a strip of stable, moisture or water-activated adhesive to permit sealing of the one piece mailer to form an envelope, when the mailer is folded in two. The two sides of the lower half of the mailer may also be provided with a stable, water-activated adhesive for completely sealing the envelope.

It is desirable that the water-activated adhesive not be conventional "natural" gum, as this type of adhesive becomes sticky with the few hundred degrees of heat encountered in a laser printer xerographic copying machine, and other high temperature printing or copying machines, and the sticky, heated natural gum would then contaminate these machines.

Instead of a stable, water-activated adhesive similar to a gum, the adhesive along the edge or edges of the lower half of the sheet may be a stable, pressure-sensitive adhesive covered with the usual strip of release coated protective paper so that, when it is desired to close the envelope, the strip of protective paper is removed and the mailer is folded up. The pressure-sensitive adhesive should be of a type which will not flow under a temperature of a few hundred degrees, and may be spaced slightly back from the edges of the area where it is to be located.

In accordance with another embodiment of the invention, the mailer may be formed of one full sheet of paper of the sizes mentioned hereinabove, with the printing to be applied on a front side of the sheet, and no printing on the back side thereof. In addition, on the lower end or portion of the imprinted back side of the sheet, an additional partial sheet of paper is provided and secured to the main upper sheet to form an envelope. Further, a strip of adhesive extends along the top of the partial sheet, with perforations immediately above the strip of adhesive. A letter would then be printed on the upper portion of the front of the main sheet of the mailer, and at the same time, addresses would be printed onto the envelope portion of the mailer, on the lower part of the front side thereof. Following printing, the message portion of the mailer would be separated from the envelope along the perforations, folded up, and inserted into the envelope, and sealed. Again, the adhesives employed would be of the stable types discussed hereinabove, which would not contaminate the laser printer or xerographic copying machines.

It may be noted that in both embodiments of the invention as discussed hereinabove, the leading or top half of the mailer is only a single continuous sheet of paper, and includes no windows or adhesive material. In this regard, it has been determined that the presence of windows or other significant irregularities in the leading edge of the mailer will tend toward jamming the office machines. It may also be noted that in both embodiments of the invention, only one side of the mailer is printed, and the other side of the mailer needs no printing. Accordingly, the mailer is only processed through the laser printer or the copier machine once.

In accordance with another specific embodiment of the invention added to this Continuation-in-Part specification, the mailer may be formed of two sheets which substantially overlie one-another, and which are secured together along one edge. The upper, or print receiving sheet, receives both the address and the letter text, with the sending and receiving addresses being located in predetermined aras on the sheet. The lower, or envelope forming sheet, is substantially coextensive with the upper sheet, and extends slightly beyond the upper sheet at the two sides of the mailer assembly. The lower half of the lower or envelope sheet is provided with two windows, so that when the lower sheet is folded in half, the addresses of the sender and of the addressee, located on the predetermined areas of the upper sheet, are visible through the windows. Incidentally, the upper, or print receiving sheet, is preferably folded to leave the upper portion of the letter exposed for viewing the addresses through the windows. To assure alignment of the addresses with the windows, the upper sheet may have an area marked or designated thereon, for receiving the addresses.

A strip of the assembly, along its upper edge spaced inward from where the two sheets are joined, may be perforated, so that, upon receipt of the mailer assembly and removal of the perforated strip, the letter may be separated from the rest of the mailer assembly.

In one example, the upper or message sheet was approximately 8 inches wide and 11½ inches long; and the envelope sheet was approximately 8½ inches wide and 10 inches long. As mentioned above, the two sheets may be permanently adhered together along their upper edges, and the lower half of the lower or envelope sheet may be provided with adhesive along its three edges, for ease in forming an envelope.

In folding the upper or letter sheet, a first fold should extend to a point just below the addresses, and the double thickness lower portion of the upper sheet should be folded again to extend to the same point, just below the addresses. The lower or envelope sheet should then be folded exactly in half and sealed to form the envelope with the addresses showing through the windows.

It may be appreciated that the embodiment of the invention as described above, and as added by this continuation-in-part, is very similar to the embodiments of the parent patent application. Common features relative to at least certain embodiments include (1) the intended use with a laser printer (2) printing on one side only of the mailer, and (3) the use of windows to permit the additional use of the addresses as they appear in the letter, to serve as addresses for mailing the envelope, so they need not be reprinted. In addition, (4) the upper portion of the mailers are of substantially constant thickness, to facilitiate the feeding of the assemblies through a laser printer without jamming.

Other objects, features, and advantages of the invention will become apparent from a consideration of the following detailed description and from the accompanying drawings.

BRIEF DESCRIPTION OF THE DRAWINGS

FIG. 8 is a top view of a two sheet mailer, similar to the single sheet mailer shown in FIGS. 1 and 2;

FIG. 11 is a cross-sectional view taken along lines XI—XI of FIG. 10.

DETAILED DESCRIPTION

Figure 1:
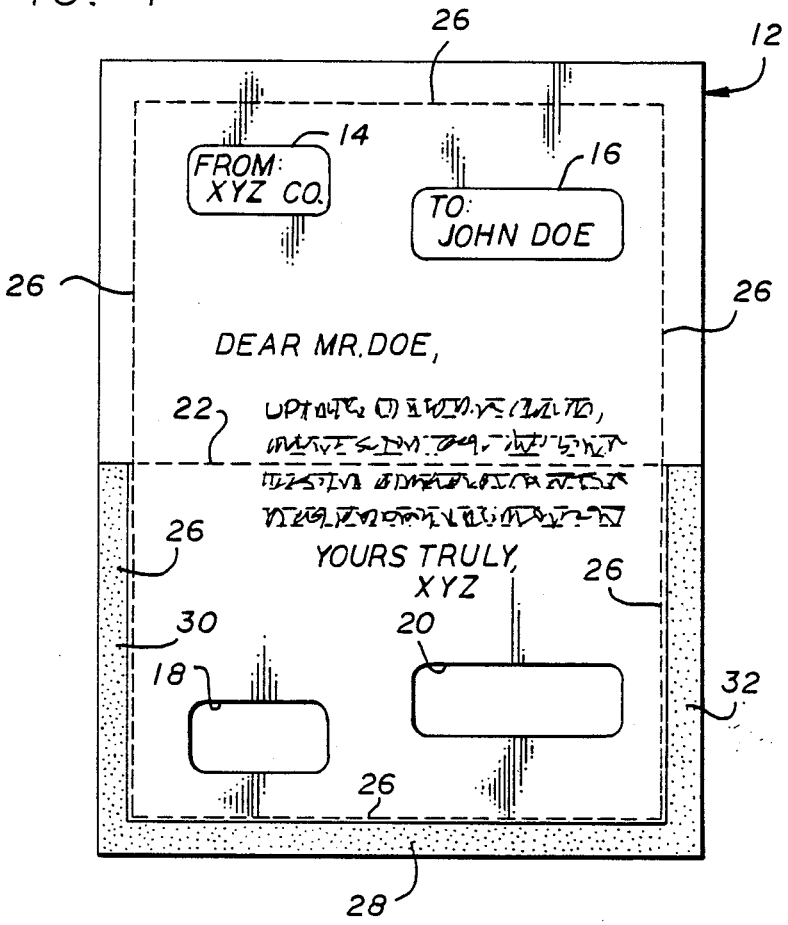
FIG. 1 is a front view of a one piece mailer in which the message is to be written on the upper portion of the mailer, and the lower portion of the mailer includes windows through which the addresses are visible.
Figure 2:
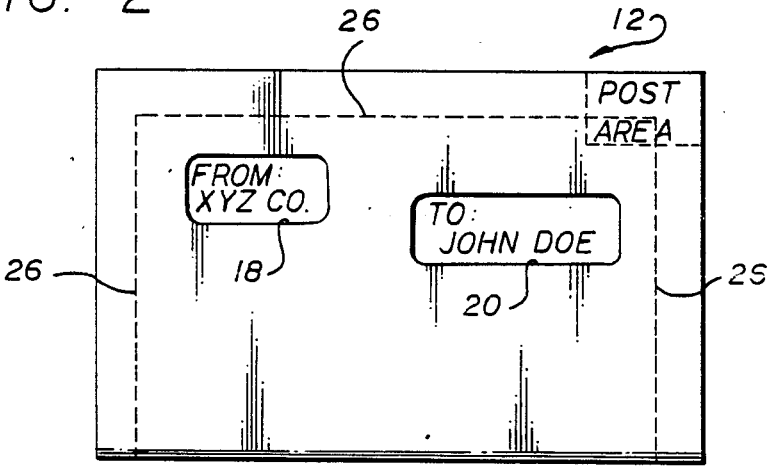
FIG. 2 shows the one piece mailer of FIG. 1 following sealing of the mailer.

Referring more particularly to the drawings, FIG. 1 shows a one piece mailer 12 for use with laser printers or xerographic copying machines. The one piece mailer includes marked areas or boxes 14 and 16 for printing the sender's name and address, and that of the addressee, respectively. In addition, windows 18 and 20 are provided, so that, when the one piece mailer 12 is folded about its horizontal center line indicated by dashed lines 22, the addresses of the sender and the addressee appear through the windows, as indicated in FIG. 2. More specifically, with reference to FIG. 2 it may be noted that the sender's name and address from the block 14 in FIG. 1 appears through the window 18, and the addressee's name and address from the area 16 of FIG. 1 appears in the window 20.

Now, returning to FIG. 1, the outer periphery of the mailer 12 may be perforated along the lines 26 for ease in opening the one piece mailer following receipt.

The lower edge of the mailer 28 is coated with a stable, water-activated, or moisture-activated adhesive which is not significantly affected by either heat or exposure to high humidity. In this regard, it is noted that so-called "natural" gum adhesives are not suitable for this purpose, as the relatively high heat of a few hundred degrees to which the paper is subject in a laser printer or by the hot rollers of a xerographic copying machine, will produce contamination to the printer or copier from adhesives such as natural gum. There are known adhesives which are moisture activated and are relatively stable in that they are not activated by temperatures of a few hundred degrees, or relatively high humidity conditions. One such adhesive is available from Adhesives Consultants Corporation, 25817 Clawiter Road, Hayward, Calif. 94545, under the trade name "Adcon FS-6". This adhesive is a polyvinyl emulsion. As noted above, other stable moisture-activated adhesives are known, and such other adhesives may be employed.

If desired, the side areas 30 and 32 may also be coated with the same type of moisture-activated adhesive, so that the mailer is more securely held together. As mentioned above, with reference to FIG. 2, when it is desired to open the mailer, the strips along the edge of the mailer may be ripped off along the perforations 26.

Figure 3:
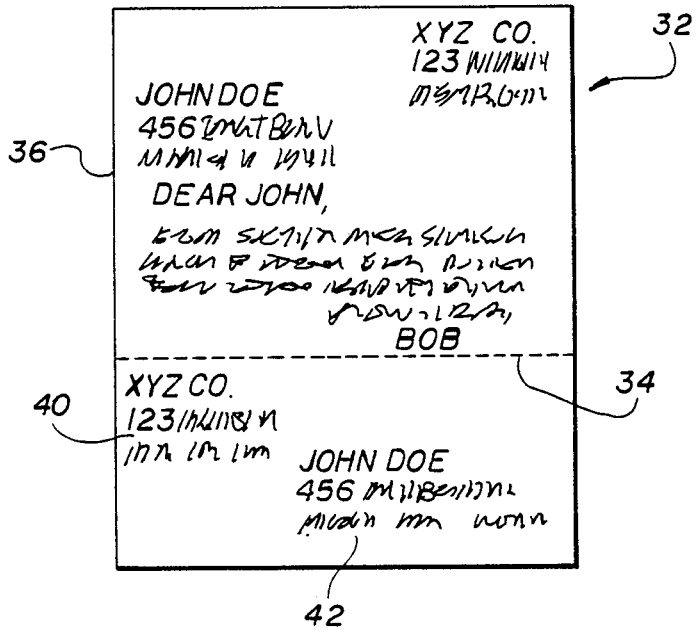
FIG. 3 is a front view of an alternative embodiment of the invention in which the upper part of the one piece mailer is available for the letter, and the lower portion is formed into an envelope.
Figure 4:
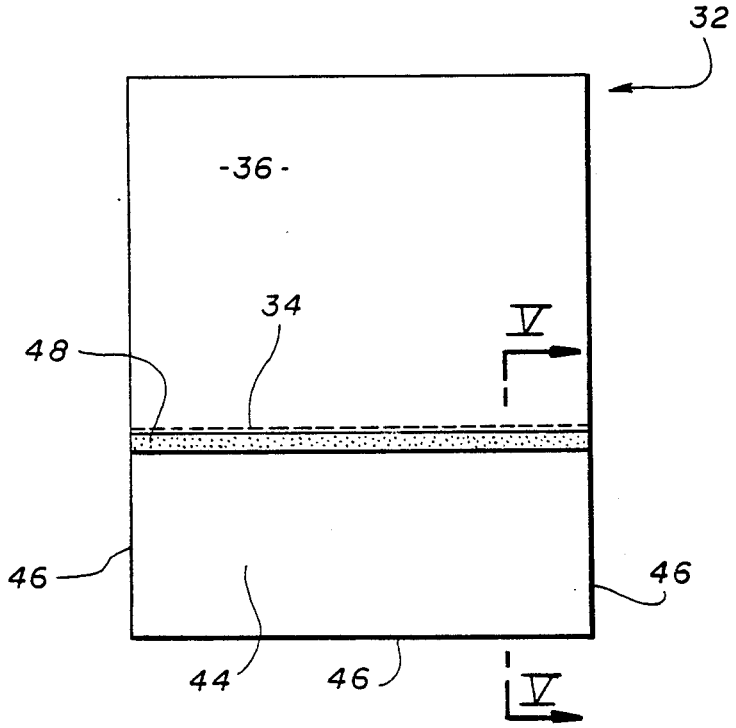
FIG. 4 is a rear view of the mailer of FIG. 3 showing the partial sheet and transverse adhesive strip which forms the envelope for the mailer.

Referring now to FIGS. 3 and 4 of the drawings, the two sides of another form of mailer 32 for use with laser printers is shown. The mailer of FIGS. 3 and 4 is divided into two areas by the transverse perforations 34. The upper portion 36 of the mailer is reserved for typing a letter or other communication to the addressee, and the lower portion 38 forms the front of an envelope, carrying the addresses of the sender at area 40, and of the addressee in area 42.

As may be seen in FIG. 4, showing the unprinted reverse side of the mailer, the lower section of the mailer is of double thickness, with an additional layer or partial sheet of paper 44 being permanently secured along three edges 46 to the back side of the lower section 38 of the sheet shown in FIG. 3. A strip of stable, water-activated adhesive 48 extends across the sheet 36 between the upper edge of the partial sheet 44, and the perforation line 34. Accordingly, when the letter or other communication has been printed, it may be removed from the envelope along the perforation line 34, folded, and inserted into the envelope formed by the lower portion of the mailer. The adhesive 48 is then moistened, and folded over to seal the envelope.

Incidentally, it may be noted that in both the case of the embodiment of FIGS. 1 and 2, and that of FIGS. 3 and 4, the laser printer or copier only prints on one side of the mailer. In addition, the leading edge of the mailer in both cases is a smooth single thickness leading edge of the sheet forming the upper portion of the mailer; and the windows in the case of FIGS. 1 and 2 or the double thickness in the case of FIGS. 3 and 4, and adhesive material, are on the trailing portion of the sheet as it passes through the laser printer or the copying machine, so that the possibility of jamming or malfunction of the laser printer or copier is minimized. Incidentally, in that regard, it has been found that, if windows are formed in the leading edge of material to be fed through a laser printer or copier, the probability of jamming is significantly increased.

Figure 5:
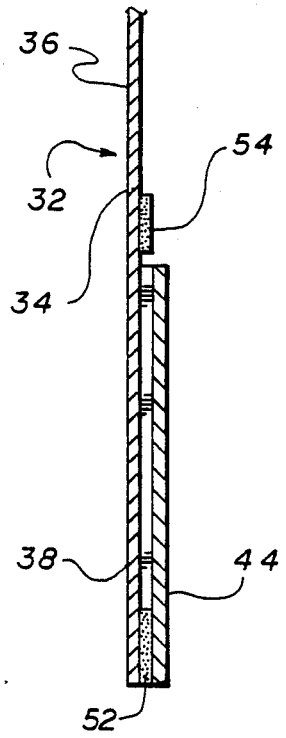
FIG. 5 is a cross-sectional view taken along lines V—V of FIG. 4.

FIG. 5 is a partial cross-sectional view taken along lines V—V of FIG. 4. It may also be noted that, in FIG. 5, the thickness of the layers of paper 36, 38 and 44 is exaggerated, as is the thickness of the permanent adhesive material 52 which extends around to partially close the envelope. The stable, moisture-activated adhesive strip 54 is also shown in FIG. 5 with an exaggerated thickness.

Figure 6:
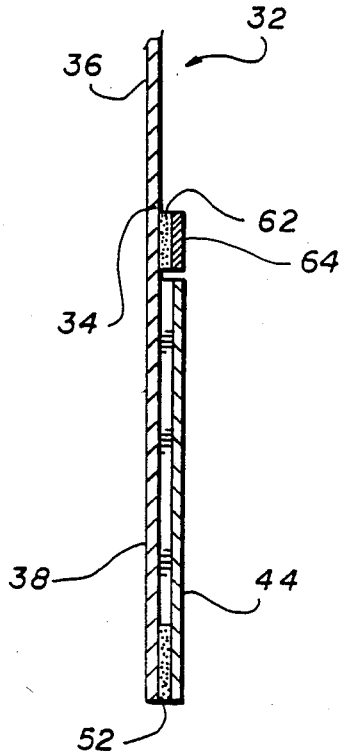
FIG. 6 shows an alternative embodiment of the invention in which pressure-sensitive adhesive is employed instead of stable water-activated adhesive.

FIG. 6 shows a slight modification as compared with the arrangement shown in FIG. 5. More specifically, instead of the stable moisture activated adhesive 54 as shown in FIG. 5, the embodiment of FIG. 6 discloses the use of a permanent, pressure-sensitive adhesive 62, covered by a thin strip of tape 64 which in turn has been coated by a release material such as silicone, on its inner surface so that it may be easily removed from the permanent, pressure-sensitive adhesive strip 62. It is also noted that the pressure-sensitive adhesive is preferably spaced back from the edge of the overlying strip by a millimeter or two of space, to avoid the possibility of flow of the pressure-sensitive material when subject to heat. Following removal of the strip 64 and the separation of the envelope at the perforations 34, the flap is folded down over the outer partial sheet 44 to seal the envelope.

Figure 7:
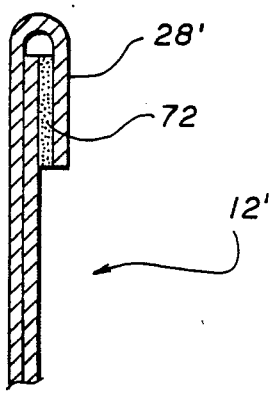
FIG. 7 shows an alternative sealing arrangement for the mailer of FIGS. 1 and 2, wherein the adhesive coated edge of the mailer folds over the upper edge of the mailer sheet.

In the arrangement of FIG. 1, it was disclosed that the gummed areas 28, 30, and 32 would engage the printed side of the upper portion of the mailer 12. An alternative arrangement is shown in FIG. 7 which shows the slightly modified mailer 12, being provided with the strip 28' folded over the upper edge of the mailer 12 with the inner strip of stable moisture activated adhesive being indicated at reference numeral 72 in FIG. 7 of the drawings. Of course, with the arrangement as shown in FIG. 7, a slight shifting of the relative positions of the windows and the zones in which the addresses appear, would be accomplished, and the line along which the strip 28, is to be folded would be slightly scored or perforated to facilitate folding.

Concerning the dimensions of the one piece mailers, it is clear that standard size envelopes are too small for handling by laser printers. Standard size paper such as 8½ by 11 inches, to 8½ by 14 and 8½ by 17 inches can definitely be used. In addition, somewhat larger paper such as 11 by 17 inch paper may be used in larger types of laser printers; and paper as short as 8½ inches wide by 6 inches long may be handled in standard laser printers.

Reference will now be made to FIGS. 8–11 which have been added in this Continuation-In-Part specification.

FIG. 8 shows a top view of a unitary two-sheet mailer, similar to the single sheet mailer of FIGS. 1 and 2. In FIG. 8 there are two predetermined areas 82 and 84 on the upper or printed message sheet 86, and these areas will line up with the openings or windows 88 and 90 in the lower or envelope sheet 92, when the envelope sheet is folded in half. The areas 82 and 84 may be marked by full light lines as shown, or only the corners of these areas could be marked. Concerning the windows 88 and 90, they are best shown in FIGS. 9 and 10.

The upper or message sheet 86 is secured to the lower or envelope sheet 92 by a narrow band of permanent adhesive 94, as shown in FIG. 11. There is a strip 96 at the upper edge of the two sheets which may be ripped off along the line 98 of perforations or partial cuts. A similar line 100 of perforations or partial cuts extends along the bottom strip 102 on sheet 92. When the envelope is received, the strips 96 and 102 are ripped off together, and the letter on the remainder of sheet 86 may be separated from the envelope sheet 92.

A U-shaped pattern of adhesive 104 is provided around the periphery of the lower half of sheet 92, to form an envelope. It may be either of the water-activated type, as mentioned hereinabove, or may be a pressure-sensitive adhesive of the type discussed hereinabove. FIG. 9 shows a protective tape 106 in the course of being removed from the adhesive material 104, in the case where permanent pressure-sensitive adhesive is employed. When pressure-sensitive adhesive is used, it may be spaced back from the edge of the paper by a few thousandths of an inch, to preclude engagement with adjacent sheets or machine parts.

Figure 9:
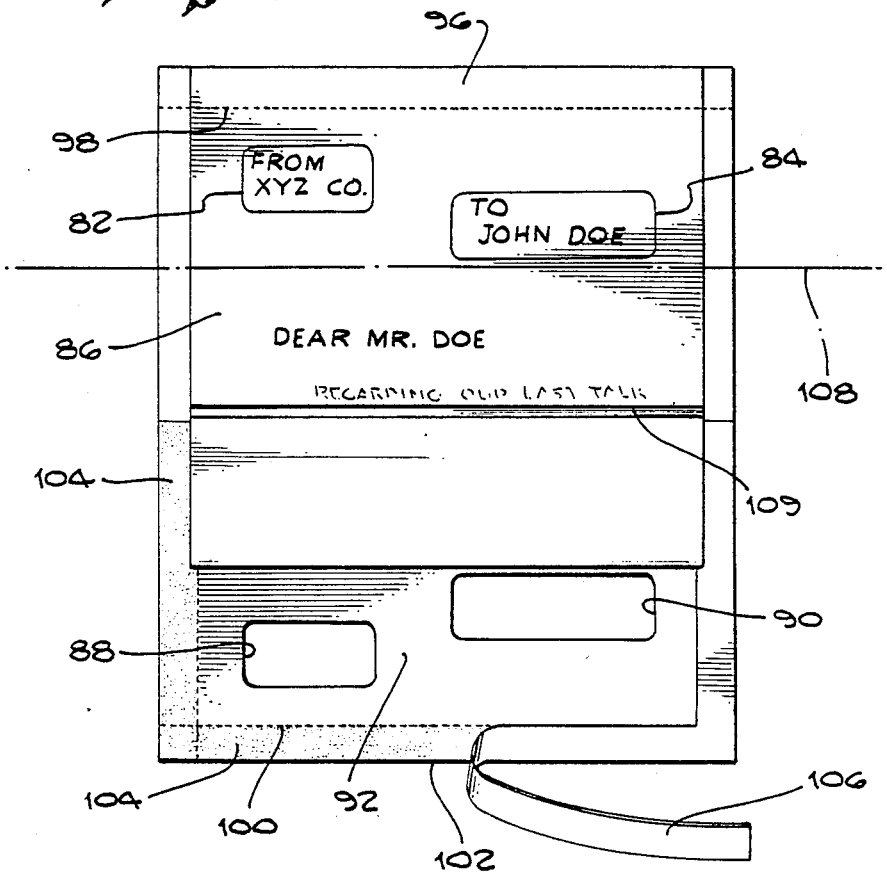
FIG. 9 shows the mailer of FIG. 8 with the message sheet partially folded in preparation for sealing of the envelope.
Figure 10:
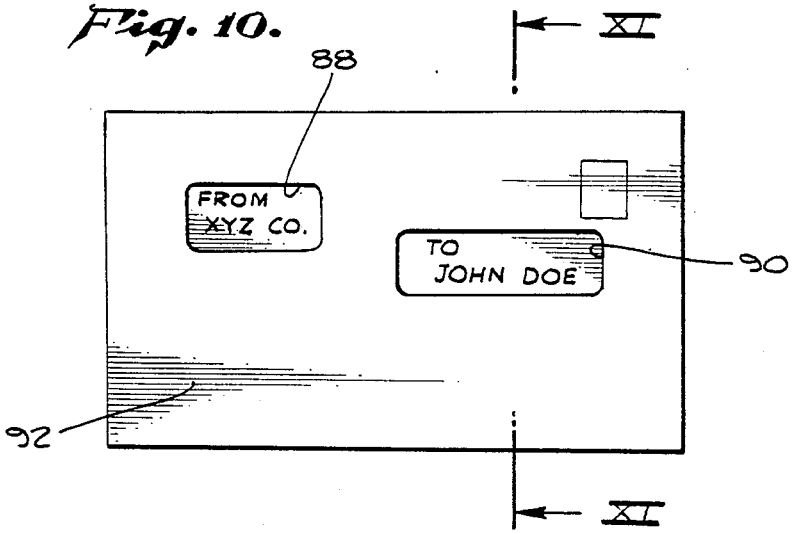
FIG. 10 shows the envelope ready for mailing, with the addresses showing through the windows.

Care must be exercised in folding the message sheet 86 up, as shown in FIG. 9, so that it will not cover the addresses, which are to be viewed through windows 88 and 90. The dash-dot line 108 indicates the maximum upward extent of the folded message sheet 86 to avoid concealing the addresses. The message sheet 86 as shown in FIG. 11 is therefore four layers thick in the area 110, as shown in FIG. 11. Referring back to FIG. 9, the message sheet 86 is initially folded once, up to line 108, and then is folded a second time, also to line 108, giving the four layers shown in FIG. 11, as mentioned above. In FIG. 9, reference numeral 109 is the lower portion of sheet 86, partially raised from line 108, following initial folding, to reveal the salutation and start of the letter.

The message sheet 86 is preferably conventional letter stock white paper, while the envelope sheet 92 is preferably of somewhat heavier paper of the type employed for envelopes, and could be an off-white or gray paper. Alternatively, the same type of paper could be used for both sheets.

Concerning dimensions, it has been noted that the unitary mailer assembly is preferably large enough to be readily accommodated in a laser printer, for example. In one example mentioned above, the upper or message sheet was 8 inches wide by 11½ inches long, and the lower or envelope sheet was approximately 8½ inches wide by 10 inches long. The windows in one example were 1 inch high, and two inches wide for the return address, and three inches wide for the addressee. The return address window was located approximately 1⅛ inch from the top of the envelope, and the addressee window was located about 1¾ inch from the top of the envelope. When the message sheet is folded, the first fold is made with the crease immediately adjacent the addressee window with the upper edge of the folded portion (about 4½ inches) extending to just below the address of the addressee. This portion of the message sheet is then folded again, as shown in FIG. 11. It is to be understood that other specific dimensions and folding arrangements may be used, without departing from the concepts of the present invention.

It may be noted in passing that the length of the message sheet 86 below the area 84 is equal to, or slightly less than four times the distance from the central fold line of the envelope sheet 92 to the area 84 and to the window 90. This permits double folding of the message sheet without blocking the view of the address areas 82 and 84 through windows 88 and 90, respectively.

In conclusion, it is to be understood that the foregoing detailed description and the accompanying drawings illustrate the preferred embodiments of the invention. However, various changes and modifications may be made without departing from the spirit and scope of the invention. Thus, by way of example and not of limitation, the stable, moisture-activated adhesive may be replaced by stable, pressure-sensitive material shielded by appropriate protective strips in each case. In addition, other forms of mailing arrangements wherein only one side of the sheet need be printed, and including the address and message on a single side of the sheet, may be employed. Accordingly, the present invention is not limited to the embodiments shown in the drawings or described in detail hereinabove.

What is claimed is:

1. A unitary mailer for use with laser type printers or copier machines, involving heating of the paper, comprising:

sheet paper means for receiving a printed message and for forming an envelope; said sheet paper means having an upper half and a lower half, and having substantially rectangular dimensions, both of which are greater than six inches, said sheet paper means being substantially uniform in thickness and continuous for its upper half;

said sheet paper means including two overlying sheets of paper permanently adhered together along one edge of each of the two sheets, with one of said sheets being a message sheet and the other of said sheets being an envelope sheet;

printed message and address information printed on one side only of said sheet paper means, with the message starting on the exposed upper half of said message sheet;

said sheet paper means including means for forming an envelope from said envelope sheet;

means for sealing said envelope including a stable adhesive which will not flow or become activated from the heat of a laser printer or a xerographic copier machine or from high humidity storage conditions;

the upper half of said message sheet having predetermined areas in which the names and addresses of the sender and the addressee are to be printed; and the lower half of said envelope sheet including window means for exposing the names and addresses of the sender and the addressee of the mailer when said envelope sheet is folded;

whereby said sheet paper means may be fed through a laser printer or a copier machine without jamming or contamination, with a single pass providing both the message and addressing.

2. A mailer as defined in claim 1 further including a weakened tear line extending across said sheets adjacent but spaced inward from said edges which are secured together.

3. A mailer as defined in claim 1 wherein said message sheet is slightly narrower and slightly longer than said envelope sheet.

4. A mailer as defined in claim 1 wherein means are provided for visibly identifying the address areas on said message sheet.

5. A mailer as defined in claim 1 wherein the length of said message sheet below the address location for the addressee's location is approximately equal to four times the distance from the address location to the center of the envelope sheet, whereby the lower portion of the message sheet may be folded twice without concealing the addresses from view through said windows.

6. A unitary mailer for use with laser type printers or copier machines, involving heating of the paper, comprising:

sheet paper means for receiving a printed message and for forming an envelope; said sheet paper means having an upper half and a lower half, having a front side and a back side, and having dimensions of approximately 8½ inches by at least 11 inches, said sheet paper means being substantially uniform in thickness and continuous for its upper half;

printed message and address information printed on said front side only of said sheet paper means, with the message starting on the upper half of said sheet paper means;

means for sealing said envelope including a stable adhesive which will not flow or become activated from the heat of a laser printer or a xerographic copier machine or from high humidity storage conditions; and said lower half of said sheet paper means including window means for exposing the names and addresses of the sender and the addressee of the mailer, and wherein the upper half of said sheet paper means has predetermined areas in which the names and addresses of the sender and the addressee are to be printed, corresponding in location to the window locations, following folding of the mailer;

whereby said sheet paper means may be fed through a laser printer or a copier machine without jamming or contamination.

7. A mailer as defined in claim 6 wherein said mailer includes two overlying sheets of paper permanently adhered together along one edge of each of the two sheets, with one of said sheets having predetermined areas for receiving addresses, and the other of said sheets having windows for overlying said predetermined areas when said other sheet is folded in half.

8. A mailer as defined in claim 7 further including a weakened tear line extending across said sheets adjacent but spaced inward from said edges which are secured together.

9. A mailer as defined in claim 7 wherein one of said sheets is slightly narrower and slightly longer than the other of said sheets.

10. A mailer as defined in claim 7 wherein means are provided for visibly identifying the address areas.

11. A mailer as defined in claim 7 wherein the length of said one sheet below the address location for the addressee's location is approximately equal to four times the distance from the address location to the center of the other sheet, whereby the lower portion of the one sheet may be folded twice without concealing the addresses from view through said windows.

12. A mailer for use with laser printers or copier machines, or the like, involving heating of the paper, comprising:

sheet paper means for receiving a printed message and for forming an envelope; said sheet paper means having an upper half and a lower half, and having rectangular dimensions of at least six inches by six inches, said sheet paper means being substantially uniform in thickness and being continuous for its upper half;

printed message and address information printed on the front side only of said sheet paper means, with the message starting on the upper half of said sheet;

said sheet paper means including means for forming an envelope; and means for sealing said envelope including a stable, water-activated, adhesive which will not flow or become activated from the heat of a laser printer or a xerographic copier machine or from high humidity storage conditions.

13. A mailer as defined in claim 12 wherein said mailer includes two overlying sheets of paper permanently adhered together along one edge of each of the two sheets, with one of said sheets having predetermined areas for receiving addresses, and the other of said sheets having windows for overlying said predetermined areas when said other sheet is folded in half.

14. A mailer as defined in claim 13 further including a weakened tear line extending across said sheets adjacent but spaced inward from said edges which are secured together.

15. A mailer as defined in claim 13 wherein one of said sheets is slightly narrower and slightly longer than the other of said sheets.

16. A mailer as defined in claim 13 wherein the length of said one sheet below the address location for the addressee's location is approximately equal to four times the distance from the address location to the center of the other sheet, whereby the lower portion of the one sheet may be folded twice without concealing the addresses from view through said windows.

17. A mailer as defined in claim 12 wherein means are provided for visibly identifying the address areas.

18. A mailer as defined in claim 12 wherein said adhesive is a pressure-sensitive adhesive.

19. A mailer as defined in claim 12 wherein said adhesive is a water-activated adhesive.

* * * * *